United States Patent [19]

Hylton

[11] 4,189,723

[45] Feb. 19, 1980

[54] ELECTRICAL RECEPTACLE PROVIDED WITH AN ALARM SYSTEM

[76] Inventor: Earl A. Hylton, 143-41 101st Ave., Jamaica,Queens, N.Y. 11435

[21] Appl. No.: 882,258

[22] Filed: Feb. 28, 1978

[51] Int. Cl.[2] ..... G08B 21/00

[52] U.S. Cl. ..... 340/568; 340/652; 340/656; 340/521

[58] Field of Search ..... 340/568, 652, 656, 517

[56] References Cited

U.S. PATENT DOCUMENTS

| | | | |
|---|---|---|---|
| 2,799,852 | 7/1957 | Barnes | 340/568 |
| 3,090,948 | 5/1963 | Cremer | 340/568 |
| 3,411,130 | 11/1968 | Schulein | 340/568 |
| 3,786,502 | 1/1974 | Stendig et al. | 340/521 |
| 3,794,989 | 2/1974 | Manley et al. | 340/652 |
| 4,002,397 | 1/1977 | Wang et al. | 340/568 |

*Primary Examiner*—Glen R. Swann, III

*Attorney, Agent, or Firm*—Friedman, Goodman & Teitelbaum

[57] ABSTRACT

An electrical receptacle has a female socket with two receiving terminals for receiving the two prongs of a male plug. Each of the receiving terminals has two electrically separated contact elements. One contact element from each of the two receiving terminals is interconnected to the main source of electric power. The other contact element from each of the two receiving terminals is connected through a switch to an alarm. When the male plug is inserted into the socket, it electrically conducts current from the first contact element to the second contact element in each of the receiving terminals, to thereby maintain the switch in one of its two positions to prevent the alarm from being energized. However, when the plug is removed from the socket, the switch moves to its second position and the alarm is energized. In an embodiment of the invention, the electrical receptacle is interconnected to the alarm in parallel with a burglar alarm system contained on the premises and both a main and auxiliary power supply are provided to thereby ensure that the burglar alarm system is constantly energized, but only connecting the electrical receptacle to the alarm when the main house current is available.

6 Claims, 5 Drawing Figures

ELECTRICAL RECEPTACLE PROVIDED WITH AN ALARM SYSTEM

BACKGROUND OF THE INVENTION

This invention relates to an alarm system and more particularly to an electrical receptacle provided with an alarm.

With an increase in burglaries there have been provided numerous types of security systems to sound an alarm when a premises has been broken into. Most of the alarm systems are directed toward protecting windows, doors, and other passageways leading into the premises. These alarm systems have become extremely complex and costly and frequently many people avoid installing them because of the cost involved and the amount of work needed for the installation process.

When a premises is burglarized, it has been found that the most common items which are taken are electrical appliances such as televisions, electrical typewriters, dictating equipment, hi-fi sets, etc. These appliances are of the type which are plugged into a wall receptacle. Therefore, when robbing the electrical appliance, the burglar must first pull the plug out of the wall before removing the appliance from the premises.

Heretofore, little attention has been given to provide an alarm system associated with each particular electrical appliance so that when the appliance is taken an alarm will go off. However, by providing an alarm system associated with each appliance, and specifically at the connection between the male plug and the wall receptacle, a simplified alarm system can be provided which is easy to install, is reduced in cost, and avoids expensive and complex installation.

SUMMARY OF THE INVENTION

Accordingly, it is an object of the present invention to provide an improved burglar alarm system.

Another object of the present invention is to provide a burglar alarm associated with particular electrical appliances which can cause an alarm to sound when the appliance is being removed from the premises.

Another object of the present invention is to provide a burglar alarm associated with the interconnection between a male plug from an electrical appliance and the wall receptacle, whereby the alarm will sound when the male plug is removed from the receptacle.

A further object of the present invention is to provide an electrical receptacle provided with an alarm system which sounds when a male plug is being removed from the receptacle.

Still another object of the present invention is to provide an electrical receptacle having an alarm system and including a dummy male plug which prevents the sounding of the alarm when no electrical appliance is connected.

A further object of the present invention is to provide a burglar alarm associated with wall receptacles and which is connected in parallel with a generalized burglar alarm system contained on the premises wherein both systems share the same alarm.

Yet a further object of the present invention is to provide an electrical receptacle having an alarm system, a burglar alarm system utilizing the same alarm, and both a main and auxiliary power supply wherein the main power supply is operative for both the burglar alarm and the receptacle alarm as long as house current is available, while the auxiliary power supply is available for the burglar alarm system alone when house current has been disconnected.

Still a further object of the present invention is to provide an electrical receptacle having an alarm system which is easy to install, simple to operate and is efficient in preventing the burglary of electrical appliances.

Briefly, the invention provides for an electrical receptacle which has at least one female socket. The socket includes two receiving terminals for receiving therein the two prongs of a male plug. Each of the receiving terminals comprises two electrically separated contact elements. A source of electrical energy is coupled between a respective first contact element of each receiving terminal. A switch is coupled between the respective second contact elements of the receiving terminals. The switch has first and second positions respectively corresponding to the presence and absence of a male plug inserted into the socket means. An alarm is coupled to the switch whereby the alarm is activated upon removal of the male plug from the socket means.

In an embodiment of the invention, the switch comprises an electromagnetic switch having a relay coil coupled between the second contact elements of the receiving terminals. A pair of switch contacts are associated with the relay coil and are placed in series with the alarm. The relay coil is energized by the presence of a male plug in the socket which causes current to pass from the first contact elements to the second contact elements of each receiving terminal. The energized relay coil maintains the pair of switch contacts electrically disconnected from each other.

In a further embodiment of the invention, the electrical receptacle is placed in parallel with a burglar alarm system existing on the premises and both share a common alarm. Furthermore, an additional relay coil is connected to the source of electricity and controls switch contacts which serially interconnect the alarm with the electrical receptacle. The source of electrical energy also serves as a main power supply for the alarm, and is connected such that the alarm is operative in response to both the electrical receptacle and the regular burglar alarm system on the premises. An auxiliary power supply is also provided which is automatically connected to the alarm when the main source of electricity fails. However, the auxiliary power supply only permits the alarm to operate in response to the burglar alarm system but prevents it from operating in response to the electrical receptacle, since it would interpret the lack of electricity as the absence of a male plug in the receptacle.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

ross sectional view of a dummy plug for preventing the alarm from sounding, and

Figure 5:
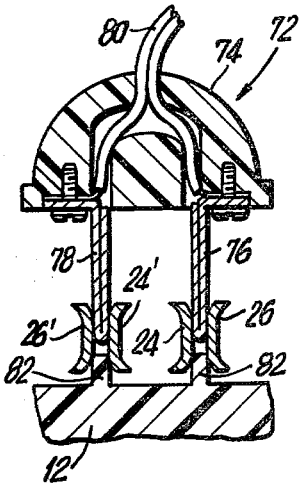

FIG. 5 is a front sectional view schematically showing a male plug inserted into the socket of the present invention.

In the various figures of the drawing, like reference characters designate like parts.

DESCRIPTION OF THE PREFERRED EMBODIMENT

Figure 1:
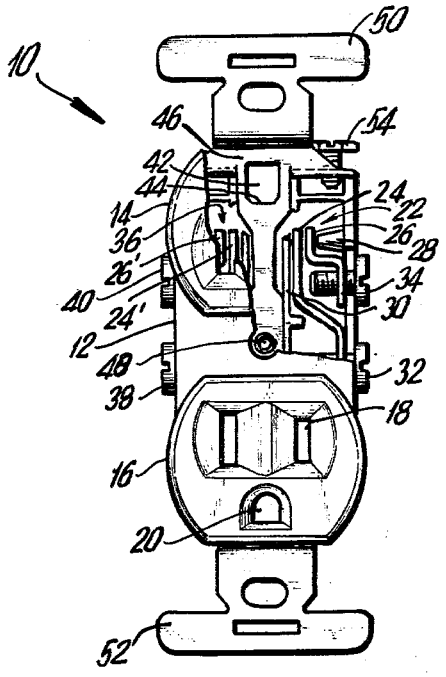
FIG. 1 is a partially broken away front view of the electrical receptacle in accordance with the present invention.

Referring now to FIG. 1 there is shown at 10 an electrical receptacle in accordance with the present invention which includes the receptacle housing 12 having an upper socket 14 and a lower socket 16. Each of the sockets includes two rectangular receiving terminals 18 and a ground terminal 20. A male plug can be inserted into each of the sockets. Either a two prong or a three prong plug can be accommodated into these sockets.

Internally of the housing it can be seen that each of ie receiving terminals is formed of spaced apart ontact elements. For example, in the receiving terminal 22, a first contact element 24 is spaced inwardly and econd contact element 26 is spaced outwardly. The contact elements 24, 26 are electrically separated n each other. However, the contact elements are ed close enough to tightly receive a prong from a plug. In order to maintain the close spacing, portions of the housing 28, 30, can be provided on the outer nner sides of the receiving terminal to keep the ct elements as close as possible without electrically touching each other.

inner contact element 24 is available for electrical nection by means of the contact screw 32. Similarly ectrical connection can be made directly to the contact element 26 by means of the screw 34.

source such as battery 70, is interconnected between the switch contacts and the alarm.

In operation, when a male plug from an electrical appliance is inserted into the socket, each of the prongs of the male plug respectively interconnect the current carrying contact elements 24, 24', with the other contact elements 26, 26' thereby sending energy to the relay coil 58 to energize it. The plunger 62 is then in a retracted position preventing the switch contacts 64 and 66 from being interconnected. As a result, the alarm 68 will not be energized. However, when the male plug from the appliance is removed from the socket, current no longer flows to the contact elements 26, 26' of the receiving terminals and accordingly the relay coil 58 will no longer be energized. Plunger 62 will then be released to interconnect the switch contacts 64, 66 so that the battery 70 can sound the alarm 68. Accordingly, as long as the electrical appliance is plugged into the wall receptacle, no alarm will be sounded. However, when an individual, typically a burglar, enters the premises and attempts to remove the electrical appliance from the premises, he must first pull the plug from the wall. In doing so, he will cause the alarm to sound. In most cases this will either frighten the burglar or bring aid such as the police or other security force.

The action of the male plug in the socket can best be seen in FIG. 5. It is noted that the conventional male plug shown generally at 72 contains an outer housing 74 formed of insulating material. Extending from the housing are prongs 76, 78, which are respectively electrically interconnected to an electrical appliance by means of the wires 80. The prongs are inserted into the socket so that they interconnect the outer contact 26' with the inner contact connection the wall within or adjacent to the receptacle itself. Alternately, a single alarm can be connected in parallel with a number of electrical receptacles so that only one alarm is needed. Furthermore, when a single receptacle contains more than one socket, as shown in FIG. 1, the power line can be connected to the electrical receptacle to supply a contact element in each of the sockets with the source of energy. The other contact elements connected to the alarm would be placed individually and connected to the alarm.

In many situations, a burglar alarm system is already provided on the premises and which is connected to windows, doors and the like, to cause an alarm to be energized when the premises are entered by an unauthorized individual. Typically, such burglar alarm systems have their own alarm such as a bell or buzzer. The electrical receptacle heretofore described can be interconnected into such burglar alarm system to make use of a common alarm. However, in such cases it would be necessary to take additional precautions to ensure that the regular house burglar alarm system is maintained activated even during a power failure. This is typically achieved by utilizing an auxiliary power source, such as a battery.

Figure 2:
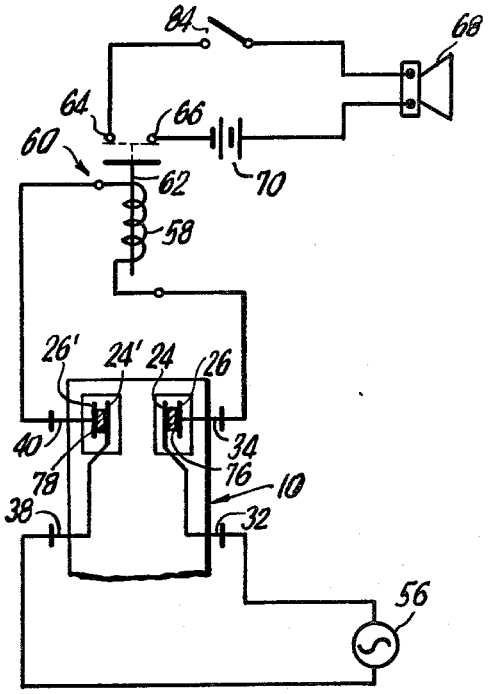
FIG. 2 is a schematic electrical drawing of the interconnection between the electrical receptacle and the alarm.
Figure 4:
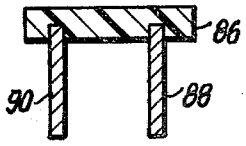
Figure 3:
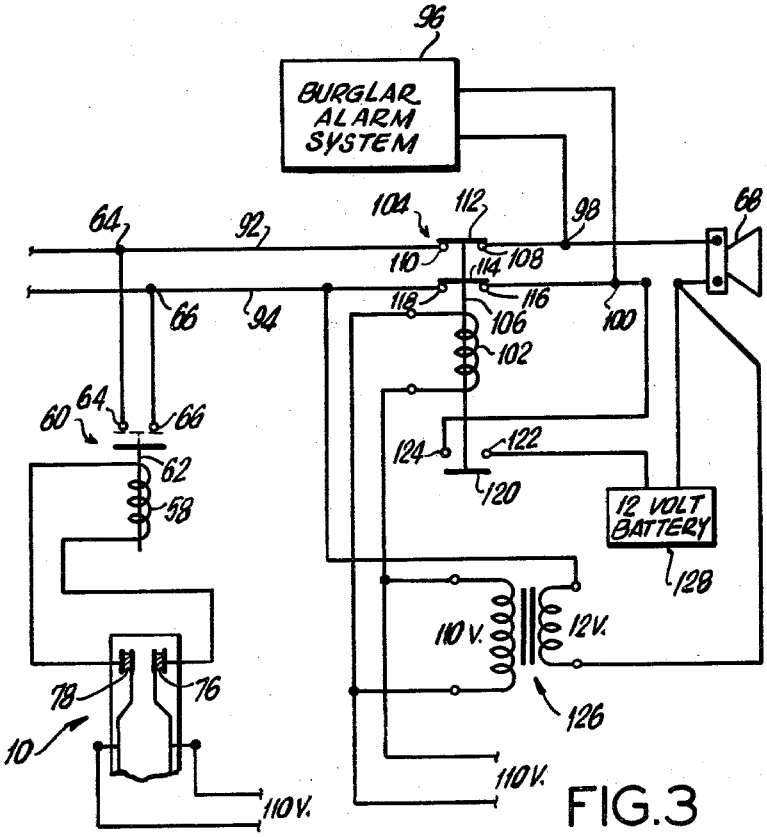
FIG. 3 is an electrical schematic drawing showing the electrical receptacle interconnected to an alarm, and including a burglar alarm system.

However, still further caution must be taken. When a power failure does occur and no main house current is provided, there would be a tendency for the electrical receptacle to sound the alarm since it would interpret the lack of power transmitted to the relay coil as resulting from the removal of a plug. This problem can be avoided by means of the circuit shown in FIG. 3. The electrical receptacle shown generally at 10 is of the type described and is interconnected to the electromagnetic switch 60 as was explained in connection with FIG. 2. However, the switch contacts 64, 66 are now connected to the lines 92, 94 which connect to alarm 68. The same lines 92, 94, can be interconnected to a plurality of such electrical receptacles. Additionally, a main burglar alarm system 96, which can be connected to windows, doors, etc. is also connected to the same alarm 68 at interconnections 98, 100. The relay coil 102 of an electromagnetic switch 104, is energized by means of the main power supply and causes a plunger 106 to be retained in its downward position. The plunger 106 has three sections, the upper two interconnecting the switch contacts 108, 110, by means of the bar 112, the second bar 114 interconnecting the switch contacts 116 and 118, and the third lower most bar 120 preventing the switch contacts 122 and 124 from interconnecting. Thus, in its energized state, the bars 112 and 114 will cause a direct connection along the main lines 92, 94, with the alarm 68.

A transformer 126 is interconnected between the main energy source and provides a reduced voltage, typically 12 volts, interconnected in series along the lines 94 from a point on either side of the switch contacts 116, 118. An auxiliary power supply 128, such as a 12 volt battery, is interconnected in series with the switch contacts 122, 124 and is then connected along the lines 94 with both ends placed on one side of the relay switch 104 and specifically adjacent to the alarm 68 so that it is between the switch contact 116 and the alarm 68.

In operation, when the main power source is provided, the relay coil 102 will be energized so that the lines 92, 94, will interconnect to the electrical receptacles 10. At the same time, the burglar alarm system 96 will, of course, be interconnected to the alarm 68. The alarm 68 is energized by means of the main power supply through the transformer 126. In the event that either the burglar alarm system is energized or a plug is removed from the electrical receptacle, the alarm 68 will sound.

Should the main house current fail by means of a power failure or the line being cut by a burglar, the coil 102 will be deenergized. As a result, line 92, 94 will be disconnected by the bars 112 and 114 being no longer interconnecting at their respective switch contacts. This will disconnect the electrical receptacles 10 from the alarm 68. The alarm 68 will no longer be supplied from the main power supply through the transformer 126 but instead will be supplied by means of the auxiliary battery 128 which is now interconnected since the bar 120 now connects its switch contacts 122, 124.

When the main power supply is disconnected, under normal circumstances, the coil 58 should release its plunger 62 to interconnect the switch contacts 64, 66 which would then sound the alarm. However, it is noted that the lines 92, 94 no longer interconnect the electrical receptacles once the power supply is disconnected. The battery 128 serves as an auxiliary power supply only for the burglar alarm system 96. This prevents the alarm from sounding when a power failure occurs, and still retains the burglar alarm system effective.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. An electrical receptacle comprising:

female socket means having first and second receiving terminals for receiving therein two prongs of a male plug, each of said first and second receiving terminals including first and second electrically separated contact elements;

coupling means for coupling a source of electrical energy between said first contact element of said first receiving terminal and said first contact element of said second receiving terminal;

first switch means coupled between said second contact element of said first receiving terminal and said second contact element of said second receiving terminal, said first switch means having first and second positions respectively corresponding to a presence and absence of a male plug inserted in said female socket means;

alarm means coupled to said first switch means whereby said alarm means is activated upon removal of the male plug from said female socket means;

said first switch means including a first electromagnetic switch having a first relay coil coupled between said second contact elements and a pair of first switch contacts serially connected to said alarm means, said first relay coil being energized by the presence of the male plug in said female socket means which causes current to pass from each first contact element to its associated second contact element in each receiving terminal, said energize first relay coil maintaining said pair of first switch contacts electrically disconnected from each other;

a burglar alarm system being electrically connected to said alarm means in parallel with said first switch means;

second switch means including a second electromagnetic switch having a second relay coil adapted to be energized by the source of electrical energy, and second switch contacts serially interconnecting said alarm means with said first switch means when said second relay coil is energized; and transformer means providing a main power source for said alarm means from the source of electrical energy, said main power source causing said alarm means to be operative responsive to both said burglar alarm system and said first switch means.

2. An electrical receptacle as in claim 1 and further comprising non-conductive means positioned between said first and second contact elements in each receiving terminal.

3. An electrical receptacle as in claim 1 and further comprising a housing unit comprising a plurality of said female socket means, wherein said coupling means interconnects the first contact elements from each pair of receiving terminals in parallel with each other.

4. An electrical receptacle as in claim 1 and further comprising a male plug having a housing of non-conductive material, and at least two prongs electrically separated from each other and supported from said housing, said electrically separated prongs being adapted to fit into said female socket means.

5. An electrical receptacle as in claim 1, wherein said female socket means further includes a ground terminal for receiving the third prong of a male plug.

6. An electrical receptacle as in claim 1 and further comprising an auxiliary power source, auxiliary switch contacts operated by said second relay coil to interconnect said auxiliary power source to said alarm means when said second relay coil is de-energized, whereby said auxiliary power source causes said alarm means to operate responsive to said burglar alarm system.

* * * * *